United States Patent [19]

Grindley

[11] Patent Number: 5,054,688

[45] Date of Patent: Oct. 8, 1991

[54] FOAM PRODUCING NOZZLE

[75] Inventor: John R. Grindley, Los Angeles, Calif.

[73] Assignee: Robwen, Inc., Los Angeles, Calif.

[21] Appl. No.: 454,021

[22] Filed: Dec. 20, 1989

[51] Int. Cl.[5] ..... B05B 7/12

[52] U.S. Cl. ..... 239/407; 239/428.5; 239/432; 239/581.1; 169/15; 417/161; 417/179

[58] Field of Search ..... 239/407, 428.5, 429, 239/432, 434, 581.1, 431; 169/15; 417/161, 179, 181, 198

[56] References Cited

U.S. PATENT DOCUMENTS

| | | | |
|---|---|---|---|
| 1,031,143 | 7/1912 | Mueller | 417/179 |
| 2,569,683 | 10/1951 | Lindsay | 239/428.5 |
| 3,082,960 | 3/1963 | Swan | 239/428.5 X |
| 3,388,868 | 6/1968 | Watson et al. | 239/432 X |
| 3,567,116 | 3/1971 | Lindlof | 239/431 X |
| 3,701,482 | 10/1972 | Sachnik | 169/15 X |
| 3,799,450 | 3/1974 | Braukman | 239/428.5 |
| 4,330,086 | 5/1982 | Nysted | 239/428.5 X |
| 4,722,670 | 2/1988 | Zweifel | 417/181 |
| 4,828,038 | 5/1989 | Williams | 169/15 |
| 4,830,790 | 5/1989 | Stevenson | 239/428.5 X |
| 4,904,182 | 2/1990 | Leshner | 239/407 X |
| 4,925,109 | 5/1990 | Flanagan et al. | 239/432 X |

FOREIGN PATENT DOCUMENTS

| | | | |
|---|---|---|---|
| 96774 | 11/1963 | Denmark | 239/428.5 |
| 535165 | 1/1922 | France | 239/431 |

*Primary Examiner*—Andres Kashnikow
*Assistant Examiner*—William Grant
*Attorney, Agent, or Firm*—Wagner & Middlebrook

[57] ABSTRACT

A nozzle assembly for aerating a pressurized liquid stream to produce a discharge of foam includes a plurality of arcuate venturi throats in a circular arrangement around the center of the nozzle together with a radial air inlet to each throat which is adjustable by relative rotation of the inlet coupling and the venturi housing. Additional turbulence may be created by a screen downstream of the venturi throats and secondary air may be admitted at that point.

6 Claims, 2 Drawing Sheets

FIG. 1
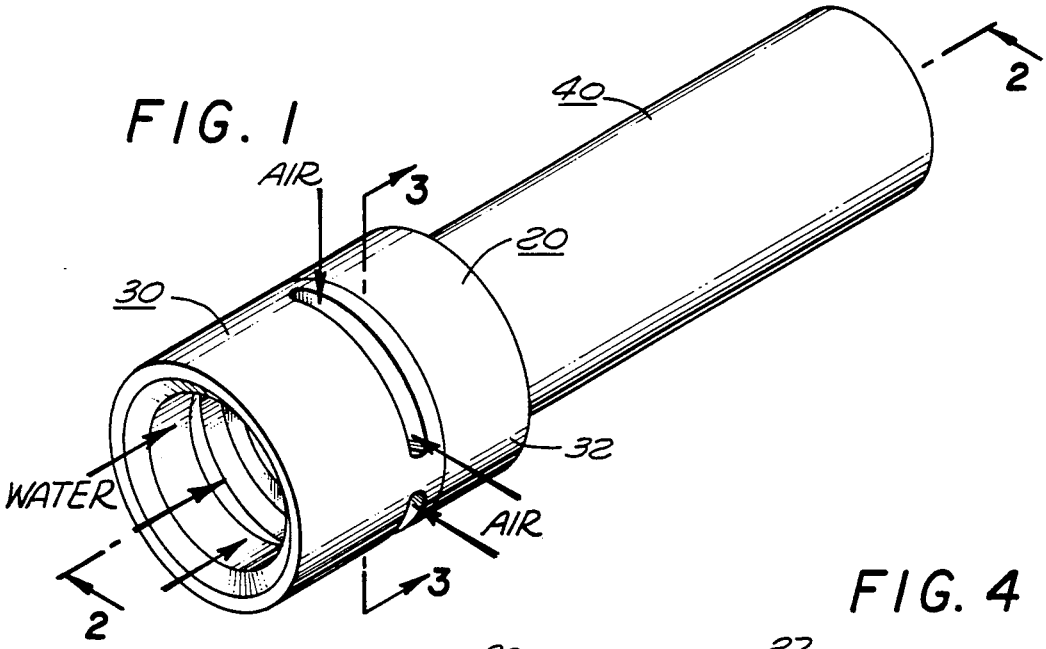
FIG. 4
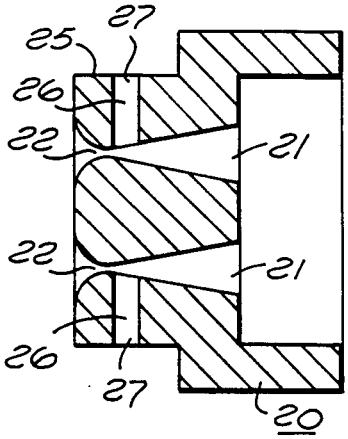
FIG. 3
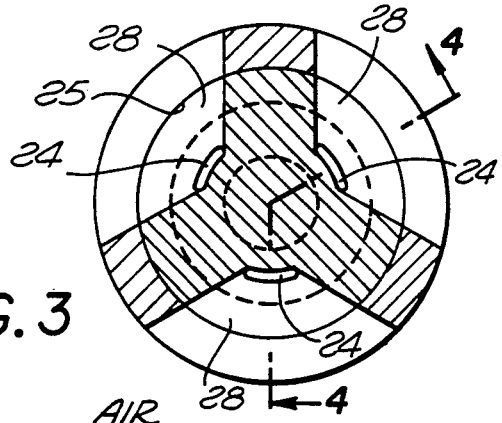
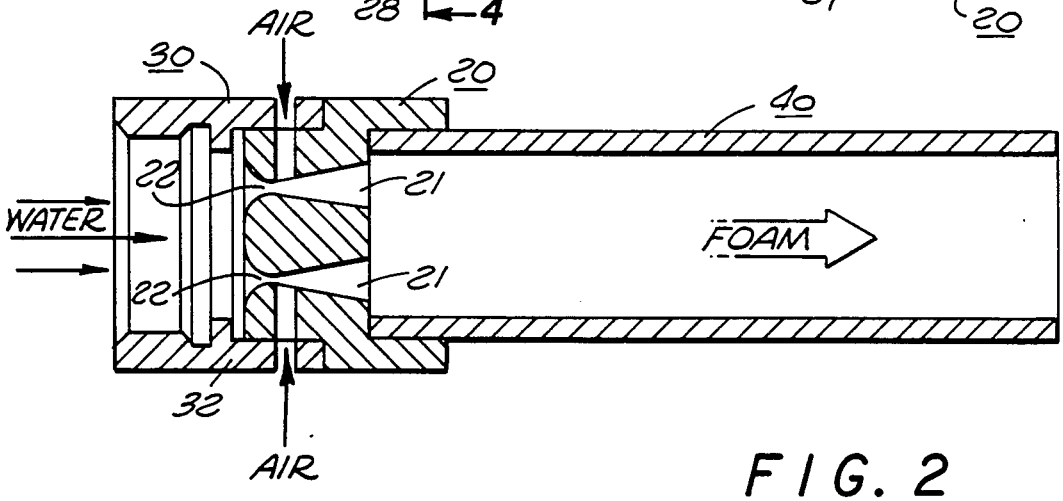
FIG. 2

FOAM PRODUCING NOZZLE

BACKGROUND OF THE INVENTION

1. Field of the Invention

The present invention relates to improvements in nozzles for aerating a pressurized liquid stream to produce a discharge of foam.

2. Description of the Prior Art

A wide variety of foam generating nozzles have been made the subject of patents disclosing such devices for the primary purpose of producing foam discharges for fire fighting, but also for other purposes such as irrigation and for shower baths.

The Webster U.S. Pat. No. 2,597,913 and Bedford, et al., U.S. Pat. No. 2,603,469 disclose nozzles embodying means for dividing a pressurized liquid stream into a plurality of streams which intersect to produce air-entraining turbulence resulting in foaming which is enhanced by the inclusion of a foaming agent in the input stream. Braukman U.S. Pat. No. 3,799,450 discloses the use of a central venturi throat in a liquid conduit to induct ambient air through radial passages into the liquid stream for aerating irrigation water.

It is the primary object of the present invention to provide an improved foam producing nozzle primarily suited for fire fighting applications, which is light in weight and of simple and rugged construction for highly effective in producing a durable foam discharge from liquid inputs of varying percentages of foaming agents.

SUMMARY OF THE INVENTION

The foam producing nozzle of the present invention is designed for use in conjunction with other equipment for mixing foaming liquid into the stream fed to a fire hose in varying percentages determined by the particular foaming liquid used and other factors.

In order to produce a greater dispersion of inducted ambient air into the liquid stream, the nozzle of the present invention employs venturi throats which are arcuate in cross section, have their outlets located between the center and the periphery of the liquid stream, and which induct air through radial passages communicating with the venturi throats near their narrowest portions. Adjustment of the volume of air inducted through these passages may be effected by partial restriction of their exterior openings.

BRIEF DESCRIPTION OF THE DRAWINGS

FIG. 1 is a view in perspective of the preferred form of a nozzle embodying the present invention.

FIG. 2 is a longitudinal sectional view of the nozzle of FIG. 1, taken on the line 2—2 of FIG. 1.

FIG. 3 is a transverse sectional view of the nozzle of FIG. 1, taken on the line 3—3 of FIG. 1.

FIG. 4 is a detail view in longitudinal section of the venturi housing embodied in the nozzle of FIGS. 1 and 5.

DETAILED DESCRIPTION OF THE PREFERRED EMBODIMENTS

Figure 5:
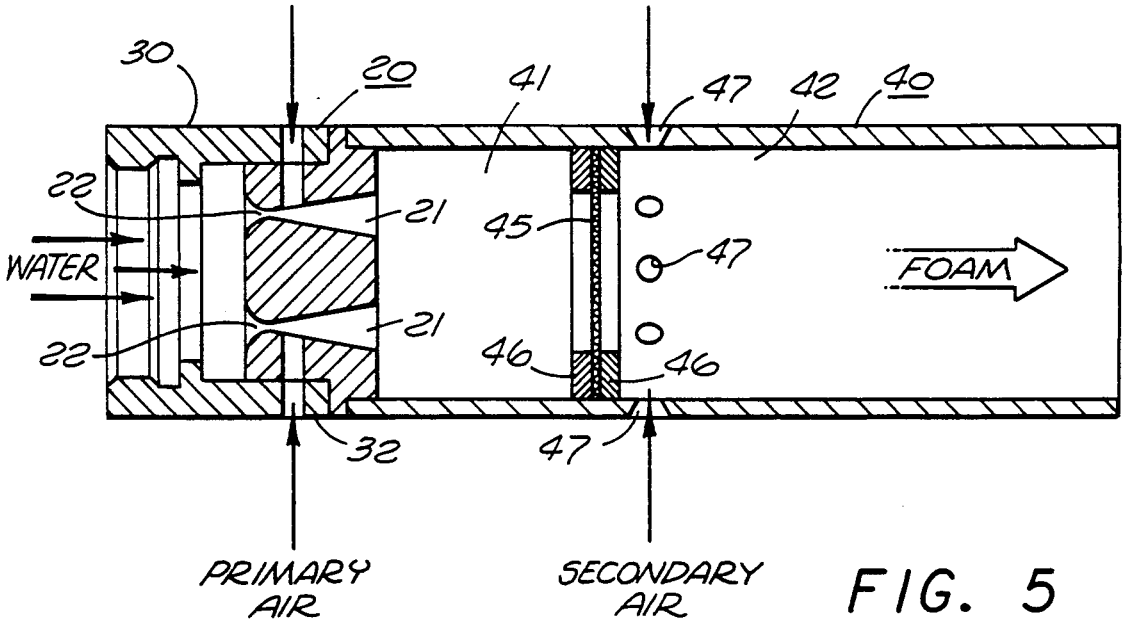
FIG. 5 is a longitudinal sectional view of a nozzle embodying the present invention including elements supplemental to those embodied in the nozzle of FIG. 1.
Figure 6:
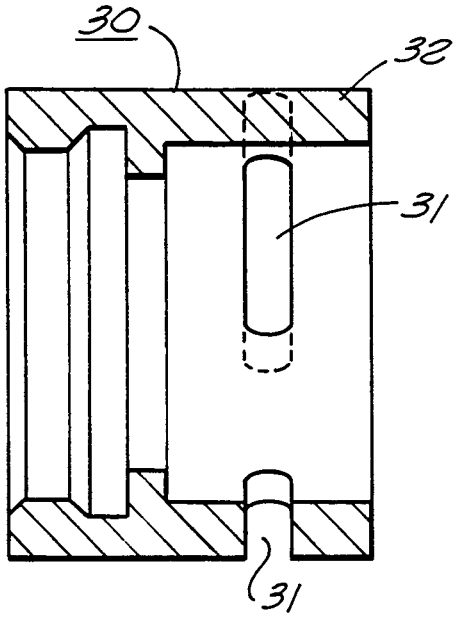
FIG. 6 is a detail view in longitudinal section of the coupling forming a part of the nozzle of FIGS. 1 and 5.

As shown in FIGS. 1 through 4 and 6 of the accompanying drawings, the nozzle of the present invention is composed of an assembly of a venturi housing 20, an inlet coupling 30 and an expansion chamber tube 40, all of which may be fabricated by injection molding of a strong, lightweight thermosetting plastic following which the three parts are cemented together as shown.

Venturi housing 20 is formed with a plurality; three, in the illustrated embodiment, of venturi throats 21 each consisting of a short tube with a constricted portion 22 which increases the velocity and lowers the pressure of fluid flowing through the passage. The throats 21 are arcuate in cross section, as shown at 24 in FIG. 3, and they are located approximately midway between the center and the periphery 25 of venturi housing 20.

A radially extending air passage 26 communicates at its inner end with the constricted portion 22 of each of the throats 21 and has its outer terminus 27 at an arcuate slot 28 which is congruent and coextensive with an arcuate slot 31 in a portion 32 of the inlet coupling 30 which telescopically embraces the venturi housing 20. This arrangement is such that, by relative rotational displacement of the venturi housing 20 and the inlet coupling 30 during assembly, restriction of the air inducted may be effected.

In circumstances in which it is desired to produce a foam discharge composed of extremely fine bubbles, the expansion chamber tube 40, as shown in FIG. 5, may be subdivided into a primary expansion chamber 41 and a secondary expansion chamber 42 by a screen 45 of woven wire or the like held in place by plastic rings 46 cemented in place. Under such circumstances, it is desirable to supplement the primary air inducted at the venturi housing 20 by providing secondary air inlets 47 downstream of the screen 45.

In the use of the nozzle assembly of the present invention, a mixture of water with a foaming agent, such as is supplied by apparatus disclosed in the co-pending application of Grindley, et al., Ser. No. 07/395,321 filed Aug. 17, 1989 for Fire Fighting Foam Mixing System, is fed through a conventional coupling into the inlet coupling 30 and passes through the venturi throats 21, inducting air through passages 36 to produce a discharge of foam into the expansion chamber tube 40. When the device of FIG. 5 is employed, this foam is further subdivided by the screen 45 and has secondary air added to it through secondary air inlets 47. In either case, the resultant foam is discharged as a stream through the open end of the expansion chamber tube 40 which is designed to be hand held at the end of a hose for easy manipulation in fire fighting.

I claim:

1. In a nozzle assembly adapted for connection to a pressurized liquid conduit, the improvement comprising:

a cylindrical venturi housing having an arcuate venturi throat disposed intermediate the central axis and the periphery of said housing and extending axially therethrough; and a radially extending air inlet passage communicating at its inner end with said throat and located at substantially the most constricted portion thereof.

2. A nozzle assembly according to claim 1 in which said air inlet passage terminates at its outer end in an arcuate opening extending circumferentially of said housing.

3. A nozzle assembly according to claim 2 including additionally:

a cylindrical coupling telescopically engaging over the outer terminus of said air inlet passage; said coupling being provided with an arcuate opening congruent with and overlying the outer terminus of said air inlet passage.

4. In a nozzle assembly adapted for connection to a pressurized liquid conduit, the improvement comprising:

a cylindrical venturi housing having a plurality of arcuate venturi throats spaced circumferentially form each other and extending axially through said housing parallel to the axis thereof; and a plurality of radially extending air inlet passages each communicating at its inner end with one of said throats and located at substantially the most constricted portion thereof.

5. A nozzle assembly according to claim 4 in which each of said air inlet passages terminates at its outer end in an arcuate opening extending circumferentially of said housing.

6. A nozzle assembly according to claim 5 including additionally:

a cylindrical coupling telescopically engaging over the portion of said venturi housing containing the outer termini of said air inlet passages; said coupling being provided with arcuate openings congruent with and overlying the outer termini of said air inlet passages.

* * * * *